US010885829B2

(12) United States Patent
Kim et al.

(10) Patent No.: US 10,885,829 B2
(45) Date of Patent: Jan. 5, 2021

(54) DRIVING CONTROLLER, DISPLAY APPARATUS HAVING THE SAME AND METHOD OF DRIVING DISPLAY PANEL USING THE SAME

(71) Applicant: Samsung Display Co., Ltd., Yongin-si (KR)

(72) Inventors: Mingyu Kim, Hwaseong-si (KR); Hee Joon Kim, Yongin-si (KR); Jae Seob Chung, Asan-si (KR); Hoi Sik Moon, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/459,365

(22) Filed: Jul. 1, 2019

(65) Prior Publication Data

US 2020/0111405 A1 Apr. 9, 2020

(30) Foreign Application Priority Data

Oct. 5, 2018 (KR) ..... 10-2018-0119181

(51) Int. Cl.
*G09G 3/36* (2006.01)
*G09G 3/20* (2006.01)

(52) U.S. Cl.
CPC ..... *G09G 3/2092* (2013.01); *G09G 3/2007* (2013.01); *G09G 2310/027* (2013.01); *G09G 2310/0251* (2013.01); *G09G 2310/0267* (2013.01); *G09G 2320/0233* (2013.01); *G09G 2340/16* (2013.01); *G09G 2360/12* (2013.01)

(58) Field of Classification Search
CPC ..... G09G 2340/16; G09G 2310/06
See application file for complete search history.

(56) References Cited

U.S. PATENT DOCUMENTS

2010/0156949 A1* 6/2010 Park ..... G09G 3/3607 345/690

FOREIGN PATENT DOCUMENTS

| | | | |
|---|---|---|---|
| KR | 10-2007-0062835 | A | 6/2007 |
| KR | 10-2008-0051598 | A | 6/2008 |
| KR | 10-0853210 | B1 | 8/2008 |
| KR | 10-2015-0030013 | A | 3/2015 |
| KR | 10-2016-0058361 | A | 5/2016 |

* cited by examiner

*Primary Examiner* — Roy P Rabindranath
(74) *Attorney, Agent, or Firm* — Lewis Roca Rothgerber Christie LLP

(57) ABSTRACT

A driving controller includes a first compensator and a second compensator. The first compensator is configured to generate first compensation data based on input image data. The second compensator is configured to generate second compensation data based on present frame data of the input image data, previous frame data of the input image data, present frame data of the first compensation data and previous frame data of the first compensation data.

20 Claims, 6 Drawing Sheets

FIG. 4

| DCC LUT | | N-1 Frame | | | | | | | | | | | | | | | | |
|---|---|---|---|---|---|---|---|---|---|---|---|---|---|---|---|---|---|---|
| | | 0 | 64 | 128 | 192 | 256 | 320 | 384 | 448 | 512 | 576 | 640 | 704 | 768 | 832 | 896 | 960 | 1024 |
| N Frame | 0 | 0 | 0 | 0 | 0 | 0 | 0 | 0 | 0 | 0 | 0 | 0 | 0 | 0 | 0 | 0 | 0 | 0 |
| | 64 | 100 | 64 | 38 | 22 | 6 | 0 | 0 | 0 | 0 | 0 | 0 | 0 | 0 | 0 | 0 | 0 | 0 |
| | 128 | 220 | 195 | 128 | 90 | 84 | 80 | 80 | 68 | 64 | 56 | 48 | 44 | 40 | 32 | 32 | 25 | 23 |
| | 192 | 460 | 390 | 280 | 192 | 154 | 152 | 132 | 112 | 100 | 80 | 60 | 60 | 60 | 50 | 44 | 40 | 36 |
| | 256 | 538 | 510 | 393 | 321 | 256 | 220 | 180 | 160 | 140 | 120 | 96 | 88 | 72 | 60 | 55 | 50 | 45 |
| | 320 | 680 | 572 | 500 | 380 | 356 | 320 | 320 | 260 | 240 | 204 | 168 | 152 | 132 | 105 | 90 | 80 | 70 |
| | 384 | 744 | 632 | 552 | 492 | 452 | 420 | 384 | 384 | 348 | 316 | 276 | 248 | 212 | 172 | 140 | 100 | 80 |
| | 448 | 772 | 692 | 620 | 580 | 552 | 524 | 488 | 448 | 448 | 424 | 364 | 304 | 252 | 200 | 178 | 165 | 158 |
| | 512 | 792 | 712 | 652 | 620 | 612 | 600 | 592 | 540 | 512 | 504 | 472 | 420 | 340 | 300 | 260 | 240 | 210 |
| | 576 | 832 | 764 | 700 | 692 | 684 | 672 | 664 | 632 | 624 | 576 | 552 | 512 | 452 | 392 | 335 | 300 | 280 |
| | 640 | 872 | 832 | 800 | 780 | 764 | 740 | 732 | 692 | 672 | 656 | 640 | 628 | 572 | 512 | 400 | 350 | 300 |
| | 704 | 880 | 852 | 832 | 820 | 812 | 800 | 792 | 780 | 772 | 760 | 732 | 704 | 692 | 640 | 600 | 540 | 500 |
| | 768 | 960 | 912 | 892 | 880 | 872 | 832 | 832 | 832 | 824 | 812 | 796 | 784 | 768 | 732 | 660 | 560 | 520 |
| | 832 | 980 | 960 | 932 | 920 | 904 | 892 | 880 | 872 | 872 | 872 | 872 | 872 | 872 | 832 | 824 | 784 | 600 |
| | 896 | 1000 | 1000 | 980 | 960 | 948 | 944 | 944 | 936 | 936 | 936 | 936 | 936 | 936 | 932 | 896 | 896 | 872 |
| | 960 | 1023 | 1023 | 980 | 972 | 968 | 968 | 960 | 960 | 960 | 960 | 960 | 960 | 960 | 960 | 960 | 960 | 960 |
| | 1024 | 1023 | 1023 | 1023 | 1023 | 1023 | 1023 | 1023 | 1023 | 1023 | 1023 | 1023 | 1023 | 1023 | 1023 | 1023 | 1023 | 1023 |

DRIVING CONTROLLER, DISPLAY APPARATUS HAVING THE SAME AND METHOD OF DRIVING DISPLAY PANEL USING THE SAME

CROSS-REFERENCE TO RELATED APPLICATION

This application claims priority to and the benefit of Korean Patent Application No. 10-2018-0119181, filed on Oct. 5, 2018 in the Korean Intellectual Property Office KIPO, the contents of which are herein incorporated by reference in their entirety.

BACKGROUND

1. Field

Exemplary embodiments of the present disclosure relate to a driving controller, a display apparatus including the driving controller and a method of driving a display panel using the display apparatus. More particularly, exemplary embodiments of the present disclosure relate to a driving controller accurately determining a compensation area to enhance display quality, a display apparatus including the driving controller and a method of driving a display panel using the display apparatus.

2. Description of Related Art

A display apparatus includes a display panel and a display panel driver. The display panel includes a plurality of gate lines, a plurality of data lines and a plurality of pixels. The display panel driver includes a gate driver, a data driver and a timing controller. The gate driver outputs gate signals to the gate lines. The data driver outputs data voltages to the data lines. The driving controller controls the gate driver and the data driver.

The driving controller may compensate input image data to generate a data signal to enhance a display quality. When the input image data are compensated, a compensation area may not be determined accurately. When the compensation area is not determined accurately, an area where compensation is not required may be compensated or an area where compensation is required may not be compensated.

SUMMARY

Aspects of embodiments of the present disclosure are directed to a driving controller accurately determining a compensation area to enhance a display quality.

Aspects of embodiments of the present disclosure are directed to a display apparatus including the above-mentioned driving controller.

Aspects of embodiments of the present disclosure are directed to a method of driving a display panel using the above-mentioned display apparatus.

According to an embodiment of the present disclosure, a driving controller is provided. The driving controller includes a first compensator and a second compensator. The first compensator is configured to generate first compensation data based on input image data. The second compensator is configured to generate second compensation data based on present frame data of the input image data, previous frame data of the input image data, present frame data of the first compensation data and previous frame data of the first compensation data.

In some embodiments, the second compensator may include a compensation area determination circuit configured to generate an enable signal based on difference between the present frame data of the input image data and the previous frame data of the input image data and a compensation application circuit configured to generate the second compensation data corresponding to the present frame data of the first compensation data and the previous frame data of the first compensation data in response to the enable signal.

In some embodiments, the compensation application circuit may be configured to add a compensation value to the present frame data of the first compensation data to generate the second compensation data when the enable signal has an active state. The compensation application circuit may be configured to generate the second compensation data with the same value as the present frame data of the first compensation data when the enable signal has an inactive state.

In some embodiments, the compensation value may correspond to the difference between the present frame data of the first compensation data and the previous frame data of the first compensation data.

In some embodiments, the first compensator may be a stain compensator configured to apply stain compensation to the input image data to compensate luminance disuniformity of a display panel.

In some embodiments, the second compensator may be an overdriving compensator configured to apply overdriving to the present frame data of the first compensation data by comparing the present frame data of the first compensation data and the previous frame data of the first compensation data to compensate for a charging rate of a pixel of a display panel.

In some embodiments, the driving controller may further include a memory configured to receive the present frame data of the input image data and delay the present frame data of the input image data to generate the previous frame data of the input image data and output the previous frame data of the input image data to the first compensator and the second compensator. The first compensator may be configured to receive the present frame data of the input image data and the previous frame data of the input image data and generate the present frame data of the first compensation data and the previous frame data of the first compensation data. The second compensator may be configured to receive the present frame data of the input image data, the previous frame data of the input image data, the present frame data of the first compensation data and the previous frame data of the first compensation data and generate the second compensation data.

In some embodiments, the second compensator may include a compensation area determination circuit configured to receive the present frame data of the input image data and the previous frame data of the input image data and a threshold grayscale value and generate an enable signal and a compensation application circuit configured to generate the second compensation data corresponding to the present frame data of the first compensation data and the previous frame data of the first compensation data in response to the enable signal.

In some embodiments, the memory may be a frame memory configured to store data corresponding to a single frame.

In some embodiments, the first compensator may be configured to receive the present frame data of the input image data and generate the present frame data of the first compensation data. The second compensator may be configured to receive the present frame data of the input image data and the present frame data of the first compensation data and generate the second compensation data.

In some embodiments, the second compensator may include a compensation area determination circuit configured to receive the present frame data of the input image data and the previous frame data of the input image data and a threshold grayscale value and generate an enable signal, a first memory configured to receive the present frame data of the input image data, delay the present frame data of the input image data to generate the previous frame data of the input image data and output the previous frame data of the input image data to the compensation area determination circuit, a compensation application circuit configured to generate the second compensation data corresponding to the present frame data of the first compensation data and the previous frame data of the first compensation data in response to the enable signal and a second memory configured to receive the present frame data of the first compensation data, delay the present frame data of the first compensation data to generate the previous frame data of the first compensation data and output the previous frame data of the first compensation data to the compensation application circuit.

In some embodiments, each of the first memory and the second memory may be a frame memory configured to store data corresponding to a single frame.

In some embodiments of a display apparatus according to the present disclosure, the display apparatus includes a display panel, a gate driver, a data driver and a driving controller. The display is configured to display an image. The gate driver is configured to output a gate signal to the display panel. The data driver is configured to output a data voltage to the display panel. The driving controller is configured to control the gate driver and the data driver. The driving controller includes a first compensator configured to generate first compensation data based on input image data and a second compensator configured to generate second compensation data based on present frame data of the input image data, previous frame data of the input image data, present frame data of the first compensation data and previous frame data of the first compensation data and output the second compensation data to the data driver.

In some embodiments, the driving controller may further include a memory configured to receive the present frame data of the input image data and delay the present frame data of the input image data to generate the previous frame data of the input image data and output the previous frame data of the input image data to the first compensator and the second compensator. The first compensator may be configured to receive the present frame data of the input image data and the previous frame data of the input image data and generate the present frame data of the first compensation data and the previous frame data of the first compensation data. The second compensator may be configured to receive the present frame data of the input image data, the previous frame data of the input image data, the present frame data of the first compensation data and the previous frame data of the first compensation data and generate the second compensation data.

In some embodiments, the second compensator may include a compensation area determination circuit configured to receive the present frame data of the input image data and the previous frame data of the input image data and a threshold grayscale value and generate an enable signal and a compensation application circuit configured to generate the second compensation data corresponding to the present frame data of the first compensation data and the previous frame data of the first compensation data in response to the enable signal.

In some embodiments, the first compensator may be configured to receive the present frame data of the input image data and generate the present frame data of the first compensation data. The second compensator may be configured to receive the present frame data of the input image data and the present frame data of the first compensation data and generate the second compensation data.

In some embodiments, the second compensator may include a compensation area determination circuit configured to receive the present frame data of the input image data and the previous frame data of the input image data and a threshold grayscale value and generate an enable signal, a first memory configured to receive the present frame data of the input image data, delay the present frame data of the input image data to generate the previous frame data of the input image data and output the previous frame data of the input image data to the compensation area determination circuit, a compensation application circuit configured to generate the second compensation data corresponding to the present frame data of the first compensation data and the previous frame data of the first compensation data in response to the enable signal and a second memory configured to receive the present frame data of the first compensation data, delay the present frame data of the first compensation data to generate the previous frame data of the first compensation data and output the previous frame data of the first compensation data to the compensation application circuit.

According to an embodiment of the present disclosure, a method of driving a display panel is provided. The method includes generating first compensation data based on input image data, generating second compensation data based on present frame data of the input image data, previous frame data of the input image data, present frame data of the first compensation data and previous frame data of the first compensation data, converting the second compensation data into a data voltage and output the data voltage to the display panel.

In some embodiments, the generating the second compensation data may include generating an enable signal based on a difference between the present frame data of the input image data and the previous frame data of the input image data and generating the second compensation data corresponding to the present frame data of the first compensation data and the previous frame data of the first compensation data in response to the enable signal.

In some embodiments, generating the second compensation data may include adding a compensation value to the present frame data of the first compensation data when the enable signal has an active state. Generating the second compensation data may include generating the second compensation data to be the same as the present frame data of the first compensation data when the enable signal has an inactive state.

According to the driving controller, the display apparatus including the driving controller and the method of driving the display panel using the display apparatus, the stain compensator generates first compensation data based on the input image data, the overdriving compensator generates second compensation data based on the input image data and the first compensation data. The overdriving compensator operates compensation using the input image data so that the overdriving compensator may accurately determine the compensation area of the overdriving compensator regardless of the result of the stain compensation. Thus, the display quality of the display panel may be enhanced.

BRIEF DESCRIPTION OF THE DRAWINGS

The above and other features and advantages of the present disclosure will become more apparent based on the below description of exemplary embodiments thereof with reference to the accompanying drawings, in which:

FIG. 4 is a diagram illustrating a DCC lookup table of FIG. 3;

DETAILED DESCRIPTION

Figure 1:
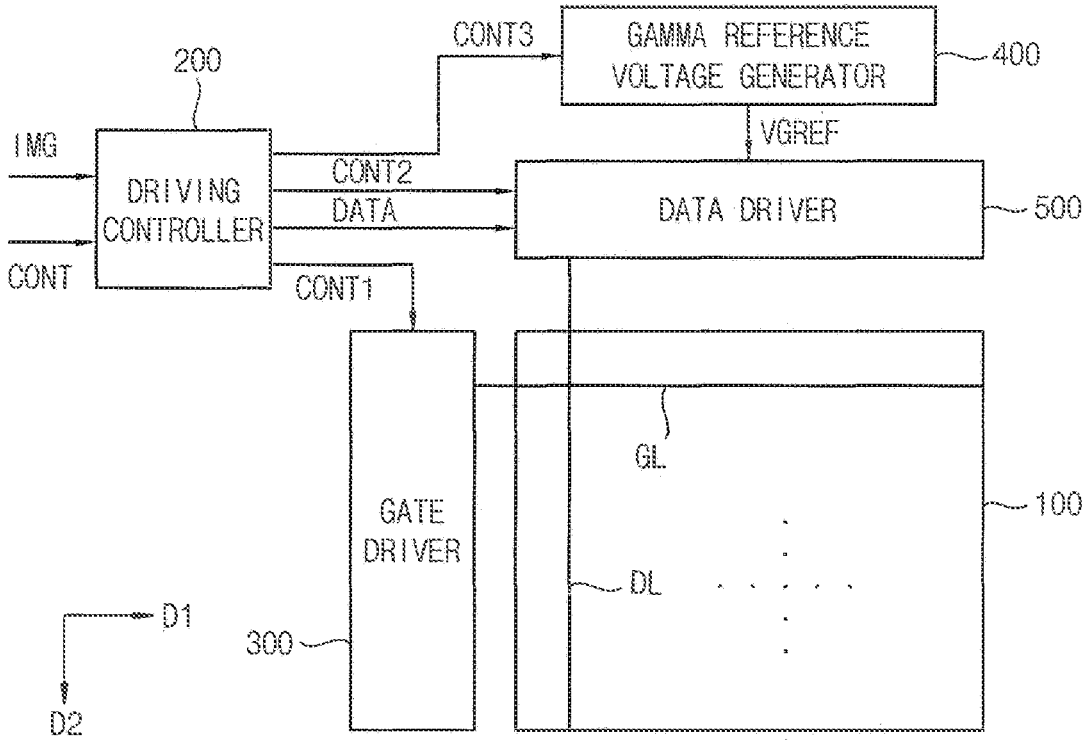
FIG. 1 is a block diagram illustrating a display apparatus according to an exemplary embodiment of the present disclosure.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

FIG. 1 is a block diagram illustrating a display apparatus according to an exemplary embodiment of the present disclosure.

Referring to FIG. 1, the display apparatus includes a display panel 100 and a display panel driver. The display panel driver includes a driving controller 200, a gate driver 300, a gamma reference voltage generator 400 and a data driver 500.

For example, the driving controller 200 and the data driver 500 may be integrally formed. For example, the driving controller 200, the gamma reference voltage generator 400 and the data driver 500 may be integrally formed. For example, the driving controller 200, the gate driver 300, the gamma reference voltage generator 400 and the data driver 500 may be integrally formed.

The display panel 100 includes a display region and a peripheral region adjacent to the display region.

For example, the display panel 100 may be a liquid crystal display panel including liquid crystal molecules. Alternatively, the display panel 100 may be an organic light emitting diode display panel including organic light emitting diodes.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. For example, the driving controller 200 may receive the input image data IMG and the input control signal CONT from a host. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500. In some embodiments, the driving controller 200 may compensate the input image data IMG to generate the data signal DATA.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages (e.g., analog data voltages) using the gamma reference voltage VGREF. The data driver 500 outputs the data voltages to the data lines DL.

Figure 2:
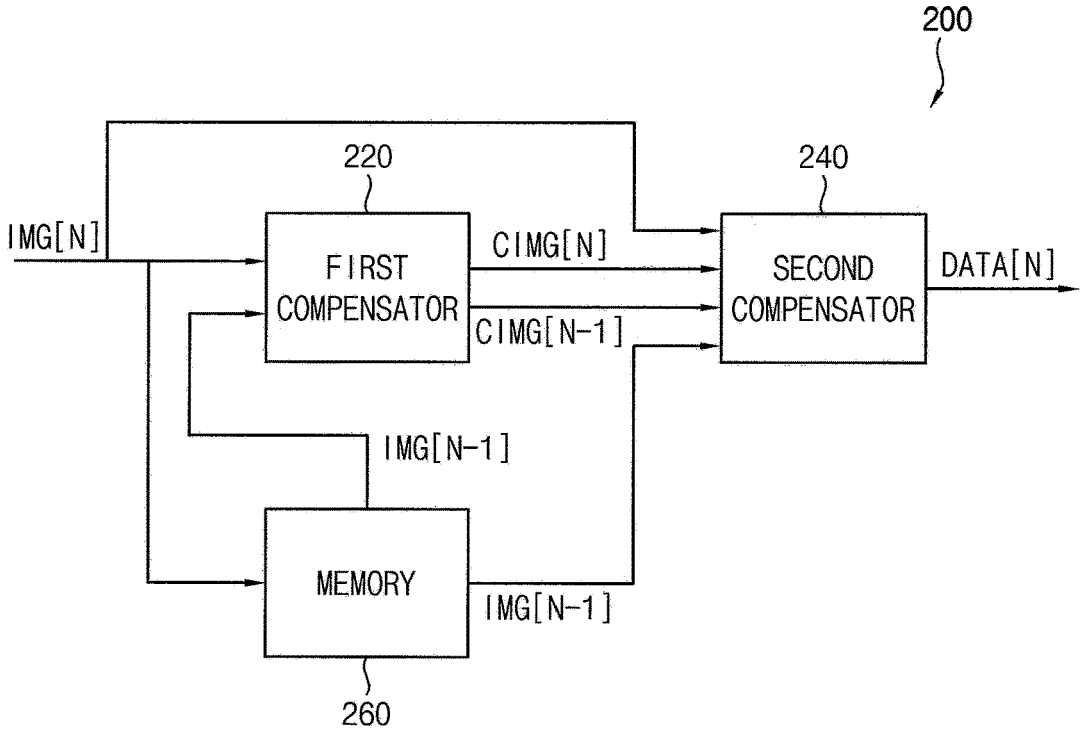
FIG. 2 is a block diagram illustrating a driving controller of FIG. 1.
Figure 3:
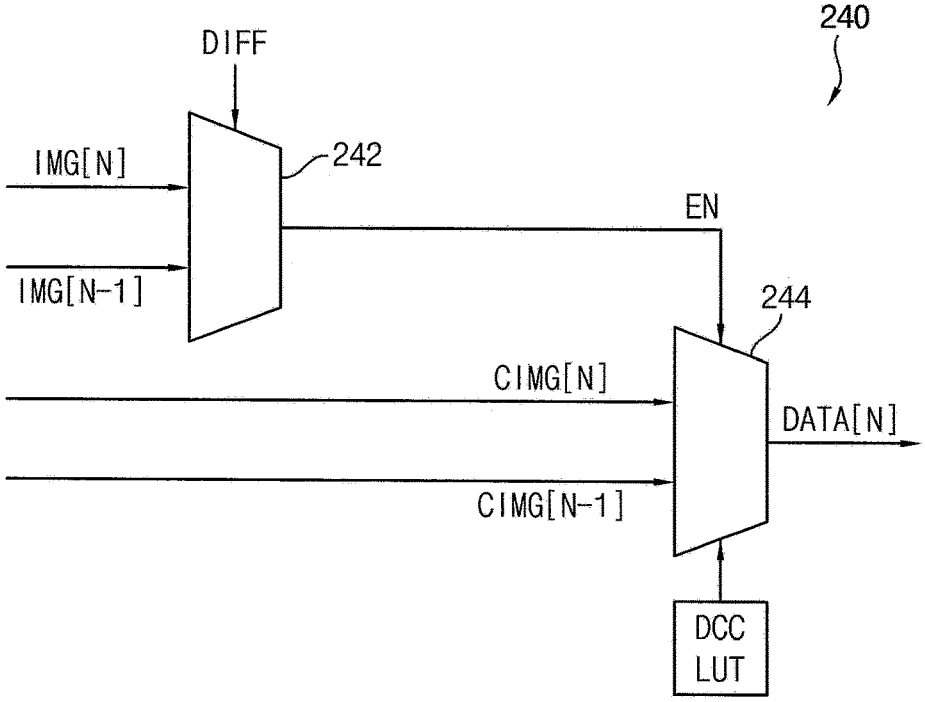
FIG. 3 is a block diagram illustrating a DCC part of FIG. 2.

FIG. 2 is a block diagram illustrating the driving controller 200 of FIG. 1. FIG. 3 is a block diagram illustrating a second compensator 240 of FIG. 2.

Referring to FIGS. 1 to 3, the driving controller 200 includes a first compensator 220 and a second compensator 240. The first compensator 220 generates first compensation data CIMG based on the input image data IMG. The second compensator 240 generates second compensation data DATA[N] based on present frame data IMG[N] of the input image data, previous frame data IMG[N−1] of the input image data, present frame data CIMG[N] of the first compensation data and previous frame data CIMG[N−1] of the first compensation data.

The first compensator 220 may be a stain compensator applying stain compensation to the input image data IMG to reduce luminance disuniformity (e.g., improve luminance uniformity) of the display panel 100. The luminance disuniformity of the display panel 100 may have various causes. For example, process variance of elements in the display panel 100 may cause the luminance disuniformity of the display panel 100. Propagation delay of a signal transmitted to the display panel 100 may cause the luminance disuniformity of the display panel 100. To reduce the luminance disuniformity of the display panel 100, the luminance of the display panel 100 may be measured. The first compensator 220 may apply a stain compensation value to decrease a luminance at a relatively bright area and a stain compensation value to increase a luminance at a relatively dark area.

The second compensator 240 may be an overdriving compensator applying overdriving to the present frame data CIMG[N] of the first compensation data by comparing the present frame data CIMG[N] of the first compensation data and the previous frame data CIMG[N−1] of the first compensation data to compensate a difference in charging rate (e.g., a reduced charging rate) of a pixel of the display panel 100. The overdriving may be dynamic capacitance compensation ("DCC") and the overdriving compensator 240 may be a DCC circuit.

The second compensator 240 may include a compensation area determiner 242 and a compensation applier 244. The compensation area determiner 242 may be a compensation area determination circuit, and the compensation applier 244 may be a compensation application circuit. The compensation area determiner 242 may generate an enable signal EN based on the difference between the present frame data IMG[N] of the input image data and the previous frame data IMG[N−1] of the input image data. The compensation applier 244 may generate the second compensation data DATA[N] corresponding to the present frame data CIMG[N] of the first compensation data and the previous frame data CIMG[N−1] of the first compensation data in response to the enable signal EN.

The compensation area determiner 242 may set the enable signal EN to an active state when the difference of a grayscale value of the present frame data IMG[N] of the input image data and a grayscale value of the previous frame data IMG[N−1] of the input image data is equal to or greater than a threshold grayscale value DIFF. In contrast, the compensation area determiner 242 may set the enable signal EN to an inactive state when the difference of the grayscale value of the present frame data IMG[N] of the input image data and the grayscale value of the previous frame data IMG[N−1] of the input image data is less than the threshold grayscale value DIFF.

The state of the enable signal EN may be set in every pixel (e.g., the enable signal EN may include a state corresponding to every pixel in the display panel 100). Herein, the pixel may be connected to the data line and the gate line and the pixel may mean a minimum unit where a data voltage is applied.

The compensation applier 244 may add a compensation value to the present frame data CIMG[N] of the first compensation data to generate the second compensation data DATA[N] when the enable signal EN has the active state.

The compensation applier 244 may generate the second compensation data DATA[N] to be the same as the present frame data CIMG[N] of the first compensation data when the enable signal EN has the inactive state.

The compensation value applied may correspond with the difference between the present frame data CIMG[N] of the first compensation data and the previous frame data CIMG [N] of the first compensation data. When the difference between the present frame data CIMG[N] of the first compensation data and the previous frame data CIMG[N] of the first compensation data is relatively great, the compensation value may be relatively great.

The compensation applier 244 outputs the second compensation data DATA[N] to the data driver 500. The second compensation data DATA[N] may be the data signal.

Hereinafter, an embodiment of operation of the second compensator 240 will be explained referring to FIGS. 4 to 6B. In the described embodiment, the second compensator 240 may be a DCC circuit.

In the present embodiment, the driving controller 200 may further include a memory 260. The memory 260 may receive the present frame data IMG[N] of the input image data and delay the present frame data IMG[N] of the input image data to generate the previous frame data IMG[N−1] of the input image data and output the previous frame data IMG[N−1] of the input image data to the first compensator 220 and the second compensator 240.

The memory 260 may be a frame memory storing the data (e.g. IMG[N]) corresponding to a single frame. In addition, the memory 260 may have a bandwidth of twice the bandwidth of a normal (e.g., conventional) frame memory to output the previous frame data IMG[N−1] of the input image data to the first compensator 220 and the second compensator 240.

The first compensator 220 may receive the present frame data IMG[N] of the input image data and the previous frame data IMG[N−1] of the input image data and generate the present frame data CIMG[N] of the first compensation data and the previous frame data CIMG[N−1] of the first compensation data.

The second compensator 240 may receive the present frame data IMG[N] of the input image data, the previous frame data IMG[N−1] of the input image data, the present frame data CIMG[N] of the first compensation data and the previous frame data CIMG[N−1] of the first compensation data and generate the second compensation data DATA[N].

In the present embodiment, the compensation area determiner 242 may receive the present frame data IMG[N] of the input image data and the previous frame data IMG[N−1] of the input image data (and, in some embodiments, the threshold grayscale value DIFF) and generate the enable signal EN.

The compensation area determiner 242 generates the enable signal EN, which determines whether overdriving is applied based on the present frame data IMG[N] of the input image data and the previous frame data IMG[N−1] of the input image data. Specifically, in some embodiments, the compensation area determiner 242 generates the enable signal EN without reference to the present frame data CIMG[N] of the first compensation data and the previous frame data CIMG[N−1] of the first compensation data. Thus, an accuracy of the determination whether the overdriving should be applied may be enhanced.

The compensation applier 244 may generate the second compensation data DATA[N] corresponding the present frame data CIMG[N] of the first compensation data and the previous frame data CIMG[N−1] of the first compensation data in response to the enable signal EN.

Figure 5A:
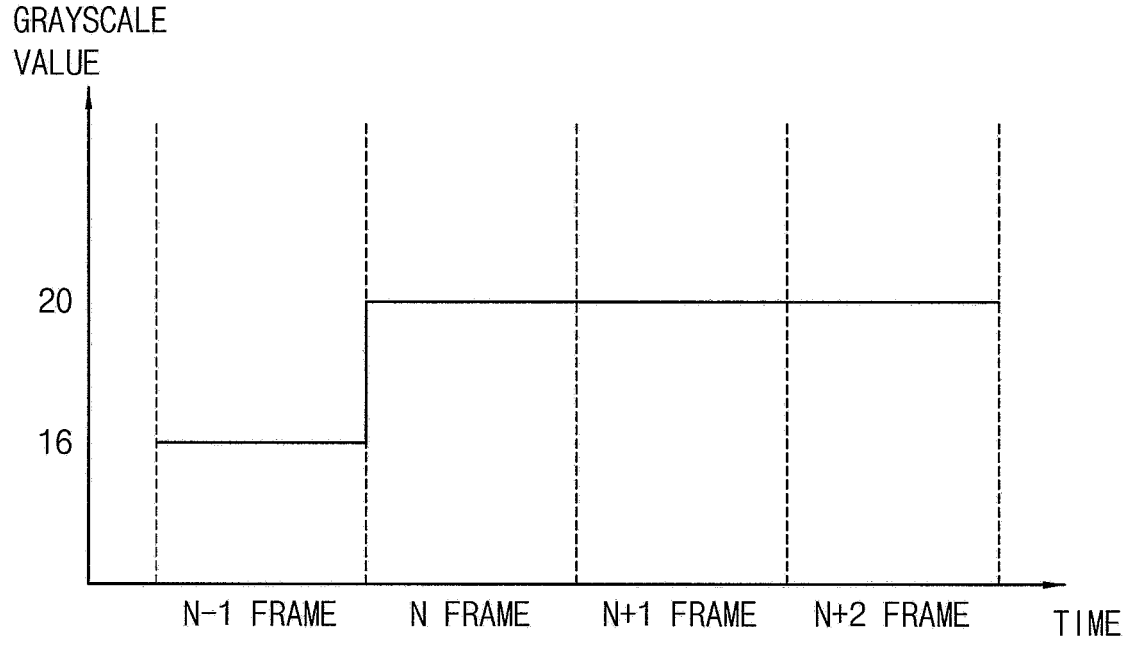
FIG. 5A is a graph illustrating grayscale values of present frame data when the second compensator of FIG. 2 does not compensate the present frame data.
Figure 5B:
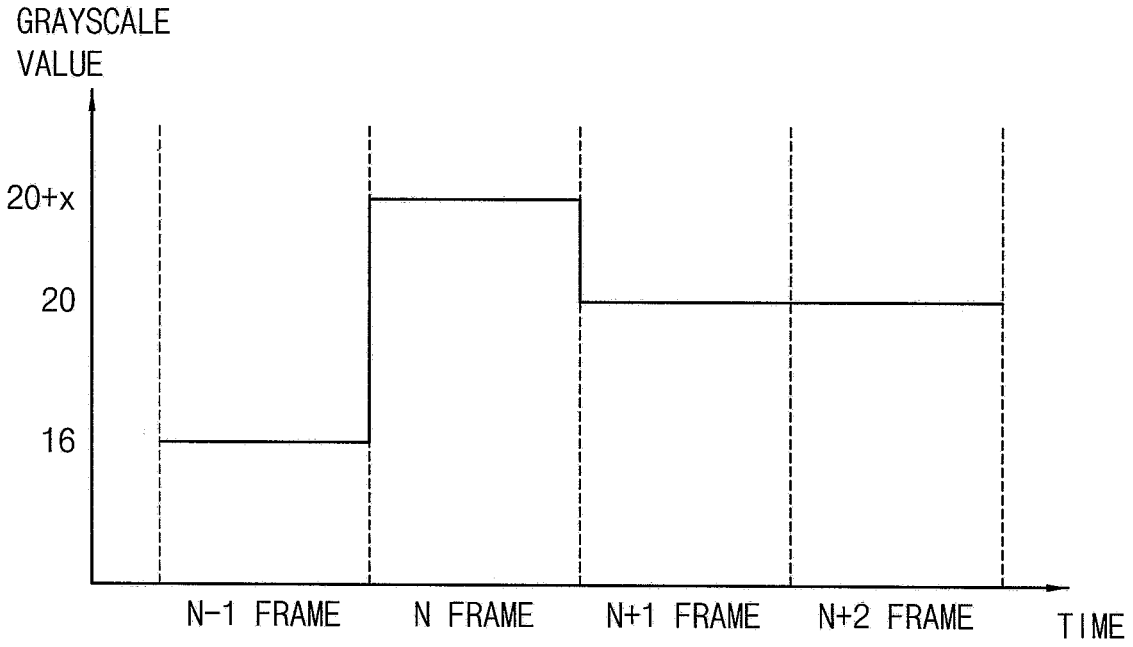
FIG. 5B is a graph illustrating grayscale values of present frame data when the second compensator of FIG. 2 compensates the present frame data.
Figure 6A:
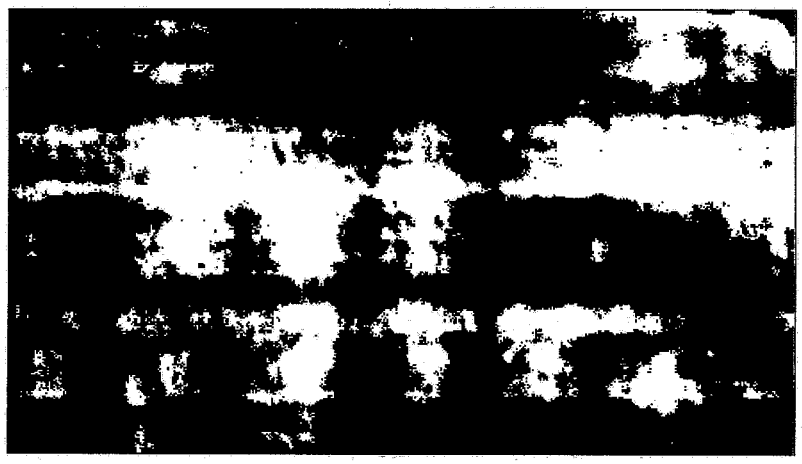
FIG. 6A is a diagram illustrating a compensation area generated by a DCC part of a comparative embodiment.
Figure 6B:
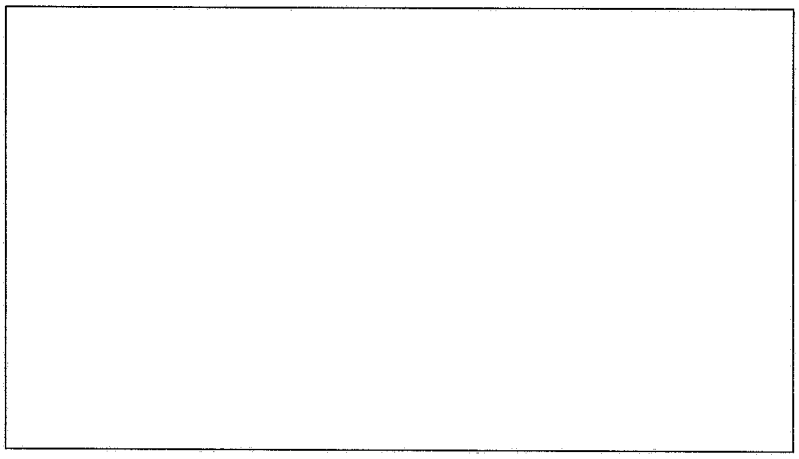
FIG. 6B is a diagram illustrating a compensation area generated by a compensation area determiner of FIG. 3.

FIG. 4 is a diagram illustrating an example embodiment of a DCC lookup table of FIG. 3. FIG. 5A is a graph illustrating grayscale values of present frame data without compensation by the second compensator 240 of FIG. 2. FIG. 5B is a graph illustrating grayscale values of present frame data when the second compensator of FIG. 2 compensates the present frame data. FIG. 6A is a diagram illustrating a compensation area generated by a DCC part of a comparative embodiment. FIG. 6B is a diagram illustrating an example embodiment of a compensation area generated by the compensation area determiner 242 of FIG. 3.

Referring to FIGS. 1 to 6B, the compensation applier 244 may generate the second compensation data DATA[N] using the DCC lookup table DCC LUT. The second compensation data DATA[N] may be the present frame data of the data signal.

The DCC lookup table DCC LUT includes a horizontal axis corresponding to greyscale values of the previous frame data N−1 Frame of the first compensation data (e.g., corresponding to the previous frame data CIMG[N−1] and a vertical axis corresponding to greyscales values of the present frame data N Frame of the first compensation data (e.g., corresponding to the present frame data CIMG[N]). The grayscale values in the table defined by the horizontal axis and the vertical axis may be used to generate the grayscale values of the present frame data DATA[N] of the data signal.

The DCC lookup table DCC LUT may store the compensated grayscale values to be used in the present frame data DATA[N] for respective grayscale values. The present frame data DATA[N] of the data signal for grayscale values not stored in the lookup table DCC LUT may be determined by interpolation of the adjacent grayscale values stored in the lookup table DCC LUT.

For example, when the grayscale value of the previous frame data N−1 Frame is 64 and the grayscale value of the present frame data N Frame is 128, the grayscale value of the present frame data DATA[N] of the data signal may be 195. When the grayscale value increases from 64 grayscale (previous frame) to 128 grayscale (present frame) and the data of 128 grayscale is applied to the pixel in the present frame, a charging rate of the pixel may be insufficient (e.g., may be too slow to charge the pixel to a level corresponding to 128 grayscale), so data of 195 grayscale may be applied to the pixel in the present frame to compensate the charging rate of the pixel.

For example, when the grayscale value of the previous frame data N−1 Frame is 64 and the grayscale value of the present frame data N Frame is 384, the grayscale value of the present frame data DATA[N] of the data signal may be 632. When the grayscale value increases from 64 grayscale (previous frame) to 384 grayscale (present frame) and the data of 384 grayscale is applied to the pixel in the present frame, a charging rate of the pixel may be insufficient (e.g., may be too slow to chare the pixel to a level corresponding to 384 grayscale), so data of 632 grayscale may be applied to the pixel in the present frame to compensate the charging rate of the pixel.

For example, when the grayscale value of the previous frame data N−1 Frame is 64 and the grayscale value of the present frame data N Frame is 64, the grayscale value of the present frame data DATA[N] of the data signal may be 64. When the grayscale value maintains 64 grayscale (previous frame and present frame), overdriving is not needed, so data of 64 grayscale may be applied to the pixel in the present frame.

For example, when the grayscale value of the previous frame data N−1 Frame is 128 and the grayscale value of the present frame data N Frame is 64, the grayscale value of the present frame data DATA[N] of the data signal may be 38. When the grayscale value decreases from 128 grayscale (previous frame) to 64 grayscale (present frame) and the data of 64 grayscale is applied to the pixel in the present frame, a discharging rate of the pixel may be insufficient (e.g., to result in the desired decrease in luminance), so data of 38 grayscale may be applied to the pixel in the present frame to compensate the discharging rate of the pixel (e.g., compensate the decrease in luminance).

FIGS. 5A and 5B represent embodiments in which the grayscale value of the previous frame data N−1 FRAME is 16 and the grayscale value of the present frame data N FRAME is 20. FIG. 5A represents an embodiment in which the second compensator 240 does not compensate the present frame data N FRAME. FIG. 5B represents an embodiment in which the second compensator 240 compensates the present frame data N FRAME.

In FIG. 5A, the present frame data N FRAME is not compensated so that the data of 20 grayscale is applied to the pixel in the present frame data DATA[N]. In contrast, in FIG. 5B, the present frame data N FRAME is compensated so that the data of 20+x grayscale, which is greater than 20 grayscale by the compensation value x, is applied to the pixel in the present frame data DATA[N].

In some embodiments, the compensation area determiner 242 generates the enable signal EN, which determines whether the overdriving is applied based on the present frame data IMG[N] of the input image data and the previous frame data IMG[N−1] of the input image data.

For example, when the difference between the grayscale value of the previous frame data IMG[N−1] of the input image data and the grayscale value of the present frame data IMG[N] of the input image data is the same as or greater than the threshold grayscale value DIFF, overdriving of the present frame data CIMG[N] of the first compensation data may be performed.

When the previous frame data IMG[N−1] of the input image data represent a single color image for an entire area of the display panel 100, the previous frame data IMG[N−1] of the input image data represent another single color image for the entire area of the display panel 100 (e.g., of another color) and the difference between the grayscale value of the previous frame data IMG[N−1] of the input image data and the grayscale value of the present frame data IMG[N] of the input image data is the same as or greater than the threshold grayscale value DIFF, overdriving of the present frame data CIMG[N] corresponding to the entire area of the display panel 100 may be performed.

However, when the difference between the grayscale value of the previous frame data CIMG[N−1] of the first compensation data and the grayscale value of the present frame data CIMG[N] of the first compensation data is compared to the threshold grayscale value DIFF, overdriving may not be applied to the entire area of the display panel 100 due to the result of the stain compensation of the first compensator 220.

FIG. 6A shows an overdriving applied area which is determined by comparing the difference between the grayscale value of the previous frame data CIMG[N−1] of the first compensation data and the present frame data CIMG[N] of the first compensation data to the threshold grayscale value DIFF. In FIG. 6A, overdriving is applied in the white area and is not applied in the black area.

When the compensation applier applies overdriving to the overdriving applied area based on FIG. 6A, the display panel 100 may display an image having a stain like FIG. 6A so that a display quality of the display panel 100 may be deteriorated.

According to embodiments of the present disclosure, when the difference between the grayscale value of the previous frame data IMG[N−1] of the input image data and the grayscale value of the present frame data IMG[N] of the input image data is compared to the threshold grayscale value DIFF by the compensation area determiner 242 of embodiments of the present disclosure, overdriving may be applied to the entire area of the display panel 100 regardless of the result of the stain compensation of the first compensator 220.

FIG. 6B shows the overdriving applied area which is determined by comparing the difference between the grayscale value of the previous frame data IMG[N−1] of the input image data and the present frame data IMG[N] of the input image data to the threshold grayscale value DIFF. In FIG. 6B, a white area is the overdriving applied area and the entire area of the display panel 100 is determined to be the overdriving applied area.

When the compensation applier 244 applies the overdriving to the overdriving applied area based on FIG. 6B, the overdriving is applied to the entire area of the display panel 100 so that a display quality of the display panel 100 may be enhanced.

According to some embodiments, the first compensator 220 generates first compensation data CIMG based on the input image data IMG, and the second compensator 240 generates second compensation data DATA based on the input image data IMG and the first compensation data CIMG. The second compensator 240 (e.g., an overdriving compensator) performs compensation using the input image data IMG so that the second compensator 240 may accurately determine the compensation area of the second compensator 240 regardless of the result of the stain compensation. Thus, the display quality of the display panel 100 may be enhanced.

Figure 7:
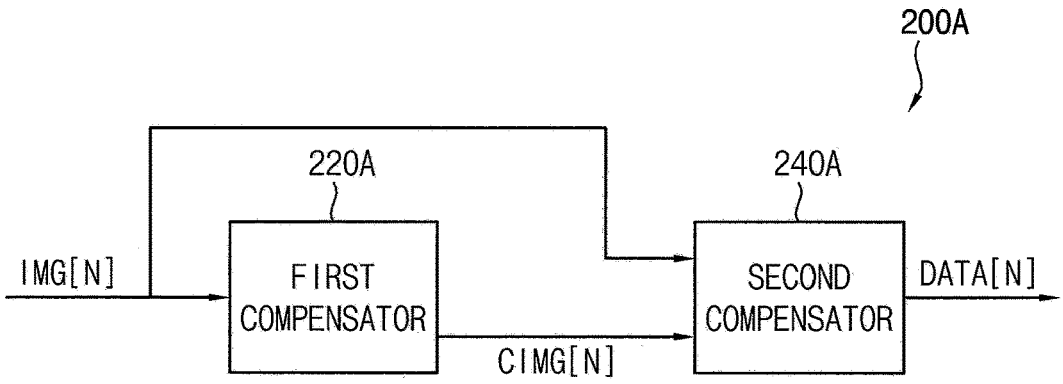
FIG. 7 is a block diagram illustrating a driving controller of a display apparatus according to an exemplary embodiment of the present disclosure.
Figure 8:
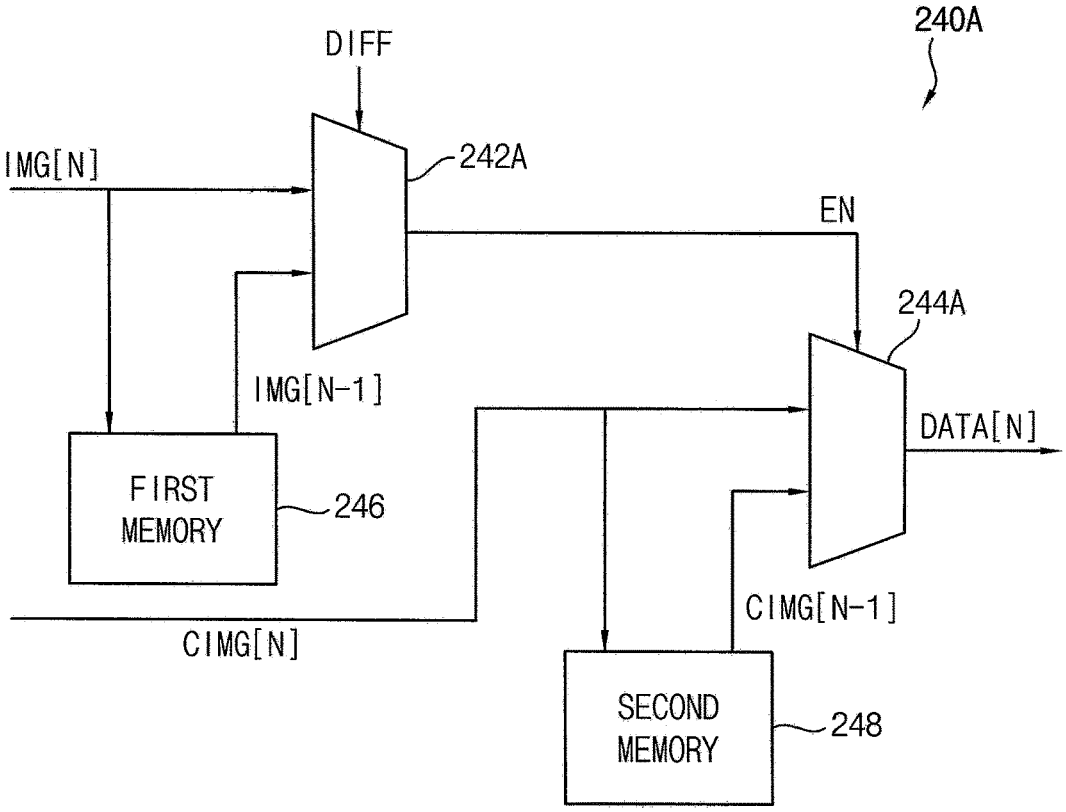
FIG. 8 is a block diagram illustrating a DCC part of FIG. 7.

FIG. 7 is a block diagram illustrating a driving controller 200A of a display apparatus according to an exemplary embodiment of the present disclosure. FIG. 8 is a block diagram illustrating an embodiment of a second compensator 240A of FIG. 7.

The driving controller, the display apparatus and the method of driving the display panel according to some embodiments are similar to or substantially the same as embodiments of the driving controller, the display apparatus and the method of driving the display panel explained above with reference to FIGS. 1 to 6B, except for the structure of the driving controller. Thus, the same reference numerals may be used to refer to the same or like parts as those described above and any repetitive explanation concerning the above elements may be omitted.

Referring to FIGS. 1 and 4 to 8, the display apparatus includes a display panel 100 and a display panel driver. The display panel driver includes a driving controller 200A, a gate driver 300, a gamma reference voltage generator 400 and a data driver 500.

The driving controller 200A includes a first compensator 220A and a second compensator 240A. The first compensator 220A generates first compensation data CIMG based on the input image data IMG. The second compensator 240A generates second compensation data DATA[N] based on present frame data IMG[N] of the input image data, previous frame data IMG[N−1] of the input image data, present frame data CIMG[N] of the first compensation data and previous frame data CIMG[N−1] of the first compensation data.

The first compensator 220A may be a stain compensator applying stain compensation to the input image data IMG to reduce luminance disuniformity (e.g., improve luminance uniformity) of the display panel 100.

The second compensator 240A may be an overdriving compensator applying overdriving to the present frame data CIMG[N] of the first compensation data by comparing the present frame data CIMG[N] of the first compensation data and the previous frame data CIMG[N−1] of the first compensation data to compensate a difference in charging rate (e.g., a reduced charging rate of a pixel of the display panel 100. The second compensator 240A may be a DCC circuit.

In some embodiments, the first compensator 220A may receive the present frame data IMG[N] of the input image data and generate the present frame data CIMG[N] of the first compensation data.

The second compensator 240A may receive the present frame data IMG[N] of the input image data and the present frame data CIMG[N] of the first compensation data and generate the second compensation data DATA[N]. The second compensator 240A outputs the second compensation data DATA[N] to the data driver 500. The second compensation data DATA[N] may be the data signal.

In some embodiments, the second compensator 240A may include a compensation area determiner 242A, a first memory 246, a compensation applier 244A and a second memory 248. The compensation area determiner 242A may be a compensation area determination circuit, and the compensation applier 244A may be a compensation application circuit. The compensation area determiner 242A may receive the present frame data IMG[N] of the input image data and the previous frame data IMG[N−1] of the input image data (and, in some embodiments, a threshold grayscale value DIFF) and generate an enable signal EN. The first memory 246 may receive the present frame data IMG [N] of the input image data, delay the present frame data IMG[N] of the input image data to generate the previous frame data IMG[N−1] of the input image data and output the previous frame data IMG[N−1] of the input image data to the compensation area determiner 242A. The compensation applier 244A may generate the second compensation data DATA[N] corresponding to the present frame data CIMG[N] of the first compensation data and the previous frame data CIMG[N−1] of the first compensation data in response to the enable signal EN. The second memory 248 may receive the present frame data CIMG[N] of the first compensation data, delay the present frame data CIMG[N] of the first compensation data to generate the previous frame data CIMG[N−1] of the first compensation data and output the previous frame data CIMG[N−1] of the first compensation data to the compensation applier 244A.

For example, the first memory 246 may be a frame memory storing the data (e.g., IMG[N]) corresponding to a single frame. For example, the second memory 248 may be a frame memory storing the data (e.g., CIMG[N]) corresponding to a single frame.

In some embodiments, the compensation area determiner 242A generates the enable signal EN, which determines whether the overdriving is applied based on the present frame data IMG[N] of the input image data and the previous frame data IMG[N−1] of the input image data (e.g., in some embodiments, the compensation area determiner 242A generates the enable signal EN without reference to the present and previous frame data CIMG of the first compensation data).

According to some embodiments, the first compensator 220A generates first compensation data CIMG based on the input image data IMG, and the second compensator 240A generates second compensation data DATA based on the input image data IMG and the first compensation data CIMG. The second compensator 240A operates compensation using the input image data IMG so that the second compensator 240A may accurately determine the compensation area of the second compensator 240A regardless of the result of the stain compensation. Thus, the display quality of the display panel 100 may be enhanced.

According to some embodiments of the driving controller, the display apparatus and the method of driving the display panel, the compensation area may be accurately determined so that the display quality of the display panel may be enhanced.

The electronic or electric devices and/or any other relevant devices or components according to embodiments of the present disclosure described herein, such as the driving controller 200, the gate driver 300, the data driver 500, and/or the gamma reference voltage generator 400 may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of the present disclosure and is not to be construed as limiting thereof. Although a few exemplary embodiments of the present disclosure have been described, those skilled in the art will readily appreciate that modifications are possible in the exemplary embodiments without materially departing from the novel teachings and advantages of the present disclosure. All such modifications are intended to be included within the scope of the present disclosure as defined in the claims. In the claims, means-plus-function clauses are intended to cover the structures described herein as performing the recited function and not only structural equivalents but also equivalent structures. Therefore, it is to be understood that the foregoing is illustrative of the present disclosure and is not to be construed as limited to the specific exemplary embodiments disclosed, and that modifications to the disclosed exemplary embodiments, as well as other exemplary embodiments, are intended to be included within the scope of the appended claims. The present disclosure is defined by the following claims and equivalents thereof.

What is claimed is:

1. A driving controller comprising:

a first compensator configured to generate first compensation data based on input image data; and a second compensator configured to generate second compensation data based on present frame data of the input image data, previous frame data of the input image data, present frame data of the first compensation data, and previous frame data of the first compensation data, wherein the second compensator is configured to receive the present frame data of the input image data and the present frame data of the first compensation data, and to generate the second compensation data.

2. The driving controller of claim 1, wherein the second compensator comprises:

a compensation area determination circuit configured to generate an enable signal based on a difference between the present frame data of the input image data and the previous frame data of the input image data; and a compensation application circuit configured to generate the second compensation data corresponding to the present frame data of the first compensation data and the previous frame data of the first compensation data in response to the enable signal.

3. The driving controller of claim 2, wherein the compensation application circuit is configured to add a compensation value to the present frame data of the first compensation data to generate the second compensation data when the enable signal has an active state, and the compensation application circuit is configured to generate the second compensation data with the same value as the present frame data of the first compensation data when the enable signal has an inactive state.

4. The driving controller of claim 3, wherein the compensation value corresponds to the difference between the present frame data of the first compensation data and the previous frame data of the first compensation data.

5. The driving controller of claim 1, wherein the first compensator is a stain compensator configured to apply stain compensation to the input image data to compensate luminance disuniformity of a display panel.

6. The driving controller of claim 1, wherein the second compensator is an overdriving compensator configured to apply overdriving to the present frame data of the first compensation data by comparing the present frame data of the first compensation data and the previous frame data of the first compensation data to compensate for a charging rate of a pixel of a display panel.

7. The driving controller of claim 1, further comprising a memory configured to receive the present frame data of the input image data, to delay the present frame data of the input image data to generate the previous frame data of the input image data, and to output the previous frame data of the input image data to the first compensator and the second compensator, wherein the first compensator is configured to receive the present frame data of the input image data and the previous frame data of the input image data and to generate the present frame data of the first compensation data and the previous frame data of the first compensation data, and wherein the second compensator is configured to receive the present frame data of the input image data, the previous frame data of the input image data, the present frame data of the first compensation data, and the previous frame data of the first compensation data, and to generate the second compensation data.

8. The driving controller of claim 7, wherein the second compensator comprises:

a compensation area determination circuit configured to receive the present frame data of the input image data, the previous frame data of the input image data, and a threshold grayscale value, and to generate an enable signal; and a compensation application circuit configured to generate the second compensation data corresponding to the present frame data of the first compensation data and the previous frame data of the first compensation data in response to the enable signal.

9. The driving controller of claim 7, wherein the memory is a frame memory configured to store data corresponding to a single frame.

10. The driving controller of claim 1, wherein the first compensator is configured to receive the present frame data of the input image data and to generate the present frame data of the first compensation data.

11. The driving controller of claim 10, wherein the second compensator comprises:

a compensation area determination circuit configured to receive the present frame data of the input image data and the previous frame data of the input image data and a threshold grayscale value, and to generate an enable signal;

a first memory configured to receive the present frame data of the input image data, delay the present frame data of the input image data to generate the previous frame data of the input image data and output the previous frame data of the input image data to the compensation area determination circuit;

a compensation application circuit configured to generate the second compensation data corresponding to the present frame data of the first compensation data and the previous frame data of the first compensation data in response to the enable signal; and a second memory configured to receive the present frame data of the first compensation data, to delay the present frame data of the first compensation data to generate the previous frame data of the first compensation data, and to output the previous frame data of the first compensation data to the compensation application circuit.

12. The driving controller of claim 11, wherein each of the first memory and the second memory is a frame memory configured to store data corresponding to a single frame.

13. A display apparatus comprising:

a display panel configured to display an image;

a gate driver configured to output a gate signal to the display panel;

a data driver configured to output a data voltage to the display panel; and a driving controller configured to control the gate driver and the data driver, the driving controller comprising:

a first compensator configured to generate first compensation data based on input image data; and a second compensator configured to generate second compensation data based on present frame data of the input image data, previous frame data of the input image data, present frame data of the first compensation data, and previous frame data of the first compensation data, and to output the second compensation data to the data driver, wherein the second compensator is configured to receive the present frame data of the input image data and the present frame data of the first compensation data, and to generate the second compensation data.

14. The display apparatus of claim 13, wherein the driving controller further comprises a memory configured to receive the present frame data of the input image data, to delay the present frame data of the input image data to generate the previous frame data of the input image data, and to output the previous frame data of the input image data to the first compensator and the second compensator, wherein the first compensator is configured to receive the present frame data of the input image data and the previous frame data of the input image data and to generate the present frame data of the first compensation data and the previous frame data of the first compensation data, and wherein the second compensator is configured to receive the present frame data of the input image data, the previous frame data of the input image data, the present frame data of the first compensation data, and the previous frame data of the first compensation data, and to generate the second compensation data.

15. The display apparatus of claim 14, wherein the second compensator comprises:

a compensation area determination circuit configured to receive the present frame data of the input image data and the previous frame data of the input image data and a threshold grayscale value and to generate an enable signal; and a compensation application circuit configured to generate the second compensation data corresponding to the present frame data of the first compensation data and the previous frame data of the first compensation data in response to the enable signal.

16. The display apparatus of claim 13, wherein the first compensator is configured to receive the present frame data of the input image data and generate the present frame data of the first compensation data, and wherein the second compensator is configured to receive the present frame data of the input image data and the present frame data of the first compensation data, and to generate the second compensation data.

17. The display apparatus of claim 16, wherein the second compensator comprises:

a compensation area determination circuit configured to receive the present frame data of the input image data, the previous frame data of the input image data, and a threshold grayscale value, and to generate an enable signal;

a first memory configured to receive the present frame data of the input image data, to delay the present frame data of the input image data to generate the previous frame data of the input image data, and to output the previous frame data of the input image data to the compensation area determination circuit;

a compensation application circuit configured to generate the second compensation data corresponding to the present frame data of the first compensation data and the previous frame data of the first compensation data in response to the enable signal; and a second memory configured to receive the present frame data of the first compensation data, to delay the present frame data of the first compensation data to generate the previous frame data of the first compensation data, and to output the previous frame data of the first compensation data to the compensation application circuit.

18. A method of driving a display panel comprising:

generating first compensation data based on input image data;

generating second compensation data based on present frame data of the input image data, previous frame data of the input image data, present frame data of the first compensation data and previous frame data of the first compensation data;

converting the second compensation data into a data voltage; and outputting the data voltage to the display panel, wherein the generating of the second compensation data comprises generating an enable signal based on a difference between the present frame data of the input image data and the previous frame data of the input image data, and wherein the second compensation data is generated in response to the enable signal.

19. The method of claim 18, wherein the generating the second compensation data comprises:

generating the second compensation data corresponding to the present frame data of the first compensation data and the previous frame data of the first compensation data in response to the enable signal.

20. The method of claim 19, wherein generating the second compensation data comprises adding a compensation value to the present frame data of the first compensation data when the enable signal has an active state, and generating the second compensation data comprises generating the second compensation data to be the same as the present frame data of the first compensation data when the enable signal has an inactive state.

* * * * *